US010619634B1

(12) United States Patent
Lundberg et al.

(10) Patent No.: US 10,619,634 B1
(45) Date of Patent: Apr. 14, 2020

(54) POWERED COMPRESSOR OIL PUMP

(71) Applicant: North Dynamics, LLC, Otsego, MN (US)

(72) Inventors: Dylan Lundberg, Otsego, MN (US); Paul Drajna, Elk River, MN (US)

(73) Assignee: North Dynamics, LLC, Otsego, MN (US)

( * ) Notice: Subject to any disclaimer, the term of this patent is extended or adjusted under 35 U.S.C. 154(b) by 281 days.

(21) Appl. No.: 15/674,061

(22) Filed: Aug. 10, 2017

Related U.S. Application Data

(60) Provisional application No. 62/376,615, filed on Aug. 18, 2016.

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |
| ***F04C 2/344*** | (2006.01) |
| ***F04C 15/06*** | (2006.01) |
| ***F04C 14/28*** | (2006.01) |

(52) U.S. Cl.
CPC ..... *F04C 2/344* (2013.01); *F04C 14/28* (2013.01); *F04C 15/008* (2013.01); *F04C 15/0061* (2013.01); *F04C 15/06* (2013.01); *F04C 2210/206* (2013.01); *F04C 2240/30* (2013.01); *F04C 2240/806* (2013.01)

(58) Field of Classification Search
CPC ..... F04C 2/344; F04C 18/344; F04C 14/28; F04C 15/0061; F04C 15/008; F04C 15/06; F04C 23/001; F04C 23/008; F04C 29/02; F04C 29/025; F04C 2210/14; F04C 2210/206; F04C 2240/20; F04C 2240/30; F04C 2240/806; F04C 2240/809; F04C 2250/10; F04C 2250/00; F04C 2250/102
USPC ..... 418/88, 91, 93, 99, 259, 266–268, 270
See application file for complete search history.

(56) References Cited

U.S. PATENT DOCUMENTS

| | | | | |
|---|---|---|---|---|
| 2,633,803 A * | 4/1953 | Carey | F04C 2/3448 | 418/229 |
| 3,201,158 A * | 8/1965 | Meripol | E21B 17/042 | 403/307 |
| 5,017,108 A * | 5/1991 | Murayama | F04C 29/025 | 418/88 |

(Continued)

FOREIGN PATENT DOCUMENTS

JP 05302580 A * 11/1993 ..... F04C 29/025

OTHER PUBLICATIONS

American Polywater Corporation; Polywater Lubricant Pump Model LP-D5; 2014; pp. 1-2.

(Continued)

*Primary Examiner* — Theresa Trieu
(74) *Attorney, Agent, or Firm* — Boyle Fredrickson S.C.

(57) ABSTRACT

A powered compressor oil pump that can be secured to a container with oil to transfer oil into a compressor or other system needing oil. The powered compressor oil pump includes a shaft that can be rotated to drive a pump mechanism such as a rotor pump mechanism. The shaft is configured to be rotated using an electrically or pneumatically powered rotary source such as a powered hand drill. The pump can be easily and securely mounted directly onto the neck of the oil container using an interface assembly or alternatively held in place using an intake pipe grip.

16 Claims, 10 Drawing Sheets

(56) References Cited

U.S. PATENT DOCUMENTS

| | | | | |
|---|---|---|---|---|
| 5,149,346 | A * | 9/1992 | Skruch | F04C 29/026 418/DIG. 1 |
| 5,271,720 | A | 12/1993 | Wall | |
| 2010/0000207 | A1 * | 1/2010 | Heaps | F04C 2/344 418/15 |

OTHER PUBLICATIONS

Zuwa-Zumpe GMBH; Drill Powered Pump With Adapter; Jan. 2013; pp. 1-2.

* cited by examiner

POWERED COMPRESSOR OIL PUMP

BACKGROUND OF THE INVENTION

1. Field of the Invention

The invention generally relates to the transfer of oil or other liquids and, more particularly, relates to a pump used to fill an oil tank or reservoir in air conditioning or refrigeration systems, and the like. The invention additionally relates to methods of using such oil pumps.

2. Discussion of the Related Art

Traditional refrigeration and cooling systems use compressors containing oil to generate cooling. This is true of small commercial refrigeration systems utilized by restaurants, liquor stores, meat and produce wholesale distributors, convenience stores, and the like. Depending on the size of the compressor, these applications typically hold between one half gallon and two gallons of oil.

The same is true of larger refrigeration systems utilized by supermarkets, large food warehouses, and food processing plants. In these applications, more complex rack systems may be used that have multiple compressors, and oftentimes three to six compressors. Generally, each compressor on a rack holds between one and a half and two gallons of oil. The compressors held by the rack system are connected such that the system load, as well as the system oil, is shared by all compressors. These systems additionally have oil separators and reservoirs which also contain oil that is shared between each compressor. Additionally, large commercial chillers can hold up to 16 gallons of oil.

To maintain these systems, oil needs to be added or replaced to their compressors on a periodic basis. In the past, primitive pump systems, such as "bicycle" style pumps, were used to pump new oil into a compressor. These pumps required a user to manually pump the oil into the compressor by moving a plunger up and down. Typically, each gallon of oil required approximately 85 pumping cycle. Depending on the efforts of the user, the flow rate of oil using a "bicycle" style pump is usually at least five minutes per gallon (0.2 gallons per minute).

Traditional "bicycle style" pumps also are not easily mountable on an oil jug in a reliable manner.

The need therefore exists to provide an oil pump that more rapidly pumps oil into a compressor of a cooling or refrigeration system with less manual effort than is required by typical manually-operated pumps.

The need still additionally exists to provide an oil pump that can be quickly and reliably installed onto a container holding oil.

The need additionally exists to provide a rapid, labor non-intensive method of pumping oil to a compressor of a cooling or refrigeration system.

BRIEF DESCRIPTION

In accordance with a first aspect of the invention, at least one of the above-identified needs is met by providing a powered pump for delivering oil to the compressor or a refrigeration or cooling system. The pump can be powered by a hand tool, such as a drill, removably connected to the pump by a drive shaft. "Powered" within the context of the invention means driven by a mechanism that is supplied with power non-manually, such as electrically or pneumatically.

In one embodiment, the pump includes a pump mechanism enclosed in a housing that can be mounted on the standard opening of a container such as the neck of an oil bottle or jug. The housing may be formed from a metal, such as aluminum that is then hard anodized, or a plastic. An inlet of the pump housing is connected to an inlet assembly. A dip tube is connected to the inlet assembly and extends into the container to remove liquid from the container. An outlet of the pump housing connects to a tube that also connects to a compressor.

The pump mechanism may comprise a rotor pump. The rotor pump may have a rotor and at least one vane that extends outwardly from the rotor towards an inner peripheral wall of the pump housing. The inner peripheral wall of the pump housing may define an eccentrically positioned, oblong cavity with the inlet and outlet ports of the cavity positioned directly opposite each other. In contrast to a typical rotary vane pump where the inlet and outlet are located 30 degrees to 45 degrees apart on the same side of the pump housing, the present invention locates the inlet and outlet 180 degrees apart enabling the inlet assembly to be inserted directly downward into the container and the outlet and outlet tube to be directed upward toward a compressor service fitting receiving the oil. This positioning of the inlet and outlet on opposite sides of the pump housing is enabled by the efficiency of the design of the eccentrically positioned, oblong fluid cavity. The vertical orientation of the pump assembly when connected and operating is facilitated by the novel positioning of the pump inlet and outlet provides significant ergonometric benefit to the pump operator by allowing for placement of the pump assembly in a position relative to operator, container, and compressor that provides maximum control, efficiency, and ease of use.

The vane of the pump rotor may be spring-loaded to bias the rotor vane towards the sidewall of the pump assembly. The vane may be formed as part of the rotor or may be a separate, replaceable component. The use of a rotor pump incorporating a vane that may be formed as part of the rotor or may be a separate, replaceable part provides significant advantages over existing compressor oil pumps in that rotor pumps with vanes may be manufactured at a lower cost than existing pumps and require significantly less maintenance than existing pumps. A rotor pump with removable vanes provides a maintenance benefit by simplifying routine maintenance of the pump to the uncomplicated and low-cost process of replacing worn out vanes. Additionally, a rotor pump used in this application will have higher efficiency than other pumps such as gear pumps. All of the materials used to form pump components may be chemically compatible with the oils typically used in compressor maintenance.

Additionally, the pump may have an inlet assembly comprising an interface fitting, an interface nut, a compression fitting, and a dip tube. The interface nut may surround the interface fitting. When the pump inlet assembly is secured directly to the container, the interface fitting, which may take the form of an elongated boss, may be inserted into an upper opening or mouth of an externally threaded neck in the container to stabilize and guide the pump. The dip tube may be connected to the interface fitting via a compression fitting and may be configured to extend into the container to receive oil from the container. The direct connection of the pump to the container facilitates control of the entire assembly by enabling the operator to hold the container itself instead of holding an unsecured inlet assembly. The interface nut is then threaded onto the neck of the container. To relieve pressure from within the container, the interface fitting may have at least one through-hole that runs from the interior of the container to the exterior of the pump.

In accordance with another embodiment of the present invention, the intake assembly may comprise a rigid intake pipe connected to the pump housing inlet and having an outer surface of sufficient length and diameter and with a texture or contour to facilitate grasping of the intake pipe by an operator's hand to stabilize the pump assembly during pump operation.

In accordance with another aspect of the invention, a method of transporting oil to a compressor of a refrigerator or cooler includes operating a hand tool such as a power drill to power a pump to transfer the oil from a container such as a jug or a bottle to the compressor.

The pump may pump oil at rates in excess of 0.25 gallons per minute (GPM), in excess of 0.5 GPM, and even in excess of 1.0 GPM.

In preparation for pumping the fluid, the method may include inserting a dip tube connected to an inlet of a pump into a container, aligning the pump with an upper opening in a neck of the container, and threading an interface nut of the pump onto the threaded neck.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION

Various embodiments of a powered compressor oil pump will now be described. The powered compressor oil pump is configured to be releasably secured to a container that contains oil for a compressor of a cooler or refrigerator or some other liquid. The powered compressor oil pump is also connected to a compressor or a system to which liquid delivery is desired. Once activated, the powered compressor oil pump will draw oil from the container, through the powered compressor oil pump, and into the compressor or other system.

Figure 1:
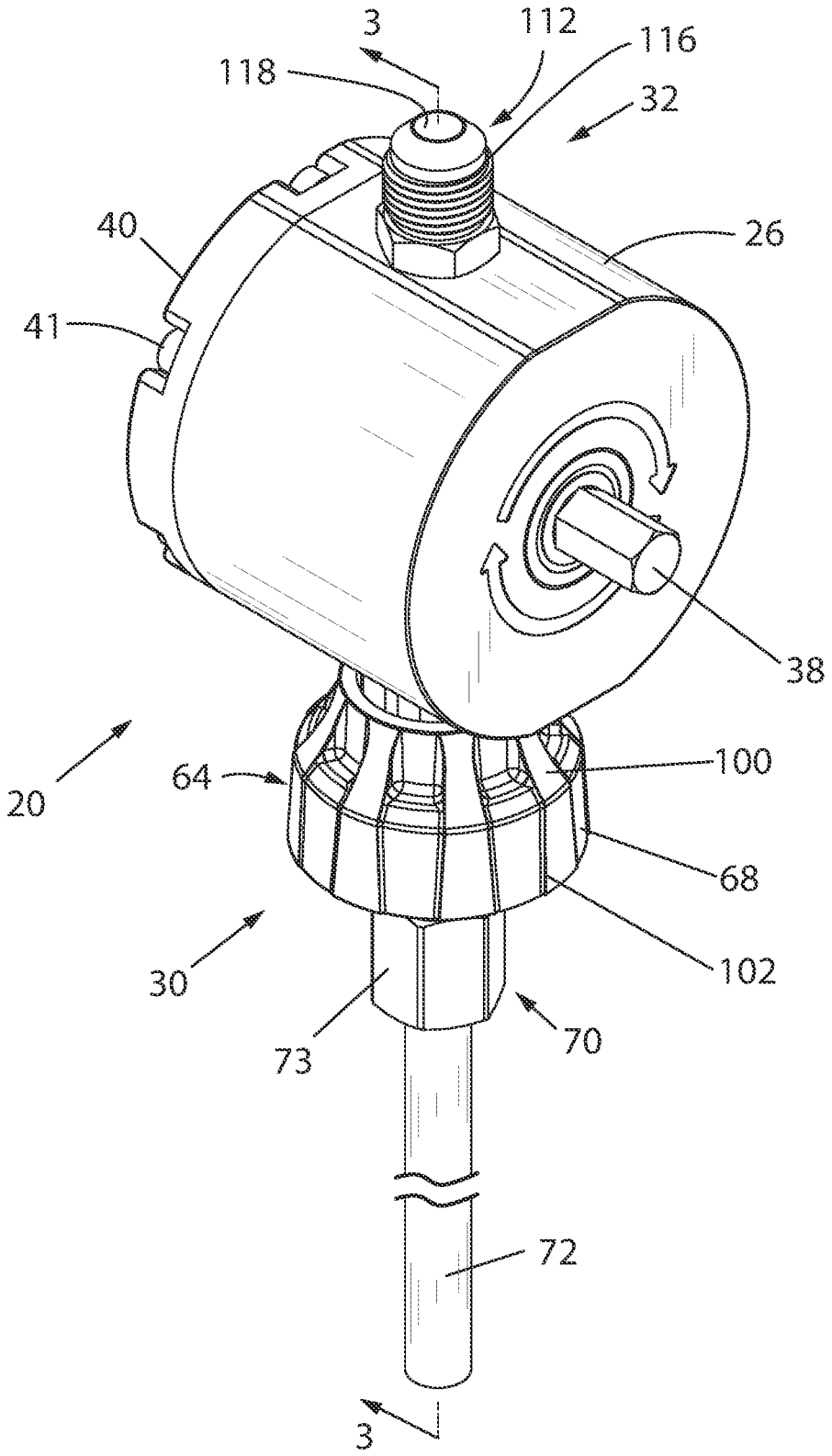
FIG. 1 is an isometric view of a powered oil pump used to fill a compressor or refrigeration system constructed in accordance with an embodiment of the invention, viewed from above, behind, and from the left side of the pump.
Figure 2:
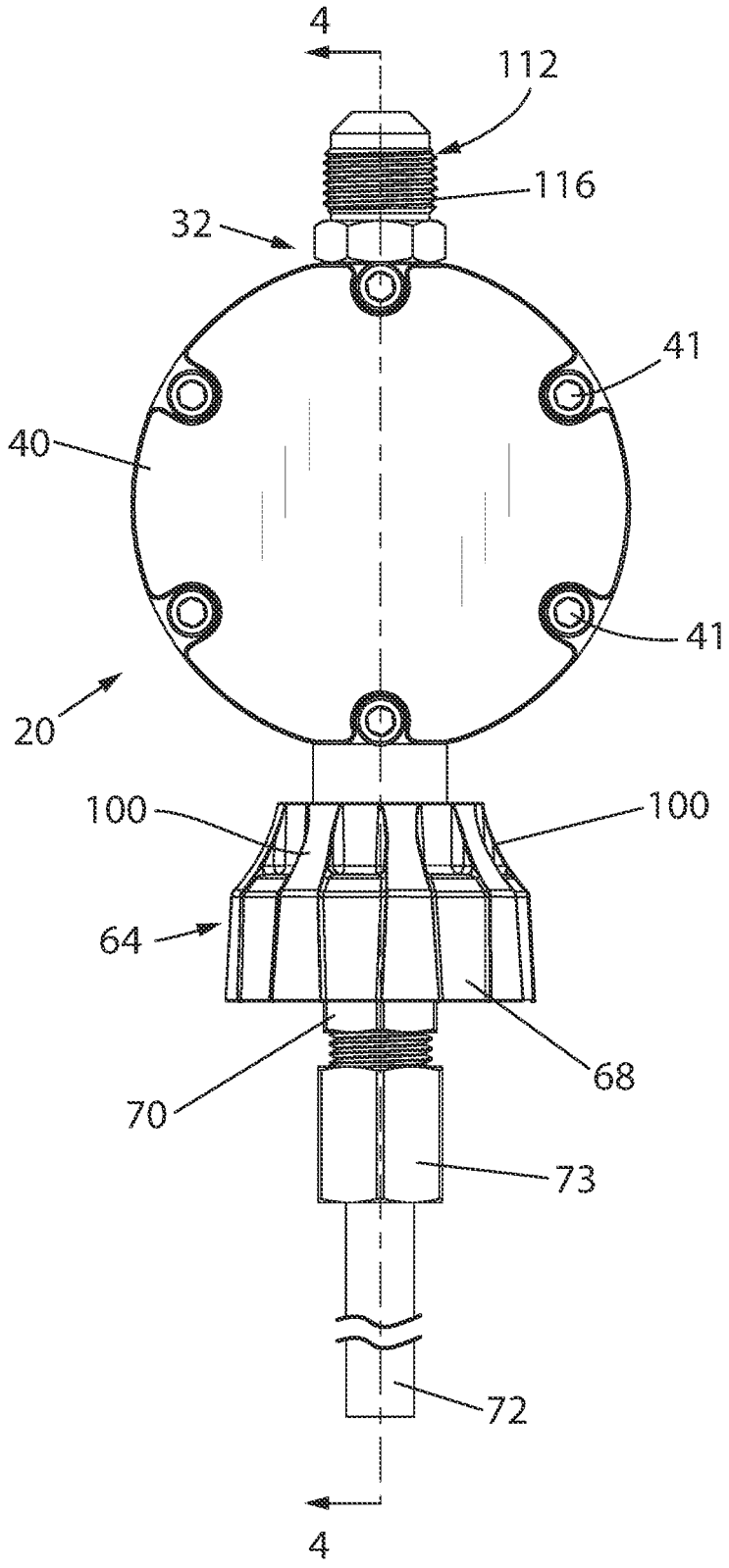
FIG. 2 is a front elevation view of the powered oil pump of FIG. 1.
Figure 3:
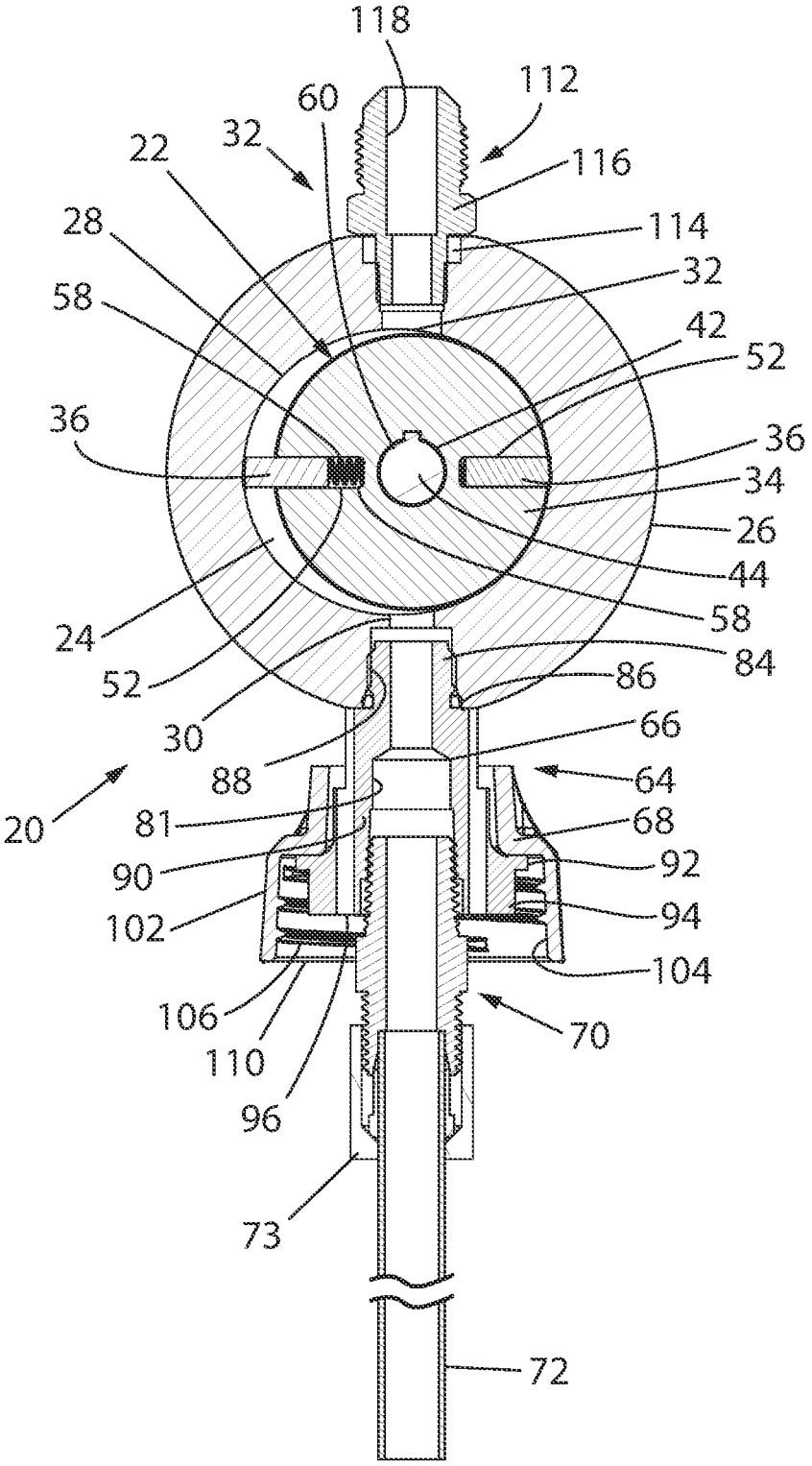
FIG. 3 is a sectional view of the powered oil pump along line 3-3 of FIG. 1.

Turning initially to all the drawings by way of broad overview, a powered compressor oil pump 20 constructed in accordance with the invention is illustrated. The As best seen in FIG. 3, the powered compressor oil pump 20 The pump 20 is configured to be driven by a power tool such as a drill to pump oil from a jug or similar container 76 to an oil storage tank 126 of a cooler or refrigerator. The pump 20 is configured to be screwed onto a threaded neck of the bottle or jug in the same manner as a standard manually-operated pump. All pump components may be chosen for their material compatibility properties with oils used in compressor maintenance. For example, aluminum, Black Delrin, and stainless steel are all compatible with mineral, alykl-benzene, PAG and POE oils which are used in this specific compressor maintenance.

As best seen in FIG. 3, includes a pump mechanism 22 found within an internal chamber 24 of a housing 26. The chamber 24 has a generally oblong inner peripheral surface 28, a lower inlet 30, and an upper outlet 32. The illustrated pump 20 is a vane pump, so the pump mechanism 22 comprises a rotor 34 and one or more vanes 36. As discussed in more detail below, however, other types of pumps having different pump mechanisms could be employed. Regardless of the construction of the pump mechanism, the pump mechanism is provided with a drive coupler 38 for mating with a hand tool such as power drill to permit powered operation of the pump. That drive coupler 38 takes the form a flanged hex drive in the illustrated embodiment.

Figure 4:
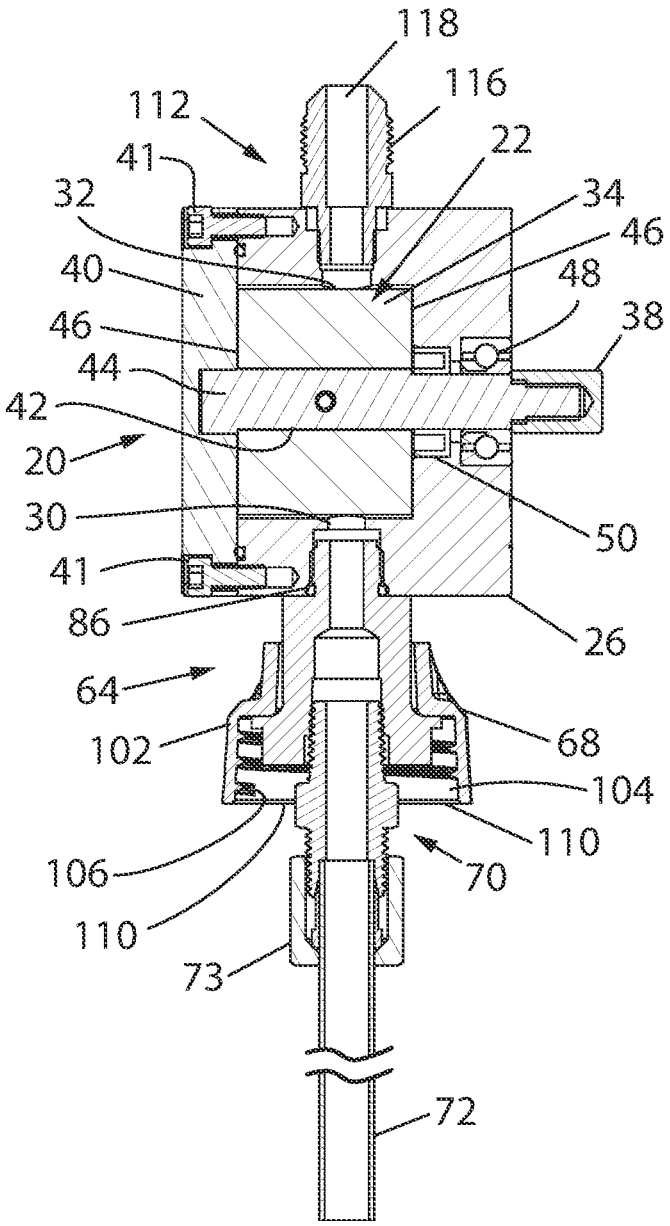
FIG. 4 is a sectional side elevation view of the powered oil pump taken along line 4-4 of FIG. 2.

Referring to FIGS. 3 and 4, the housing 26 is closed by a removable end cap 40, which is mechanically secured to the housing 26 by bolts 41 to retain the pump mechanism 22 in the internal chamber 24. The housing 26 and end cap 40 may be formed from a metal, such as steel or anodized aluminum, or a plastic. As shown, the pump mechanism 22 includes a cylindrical rotor 34. An opening 42, configured to accommodate a shaft 44, extends axially through the center of the rotor 34. The shaft 44 is keyed to lock within the opening 42. Alternatively, the shaft 44 and rotor 34 could be of a one-piece molded design, or the shaft 44 and rotor 34 could be separately manufactured and mechanically coupled, for instance by a press fit or threading.

Referring to FIG. 4, the shaft 44 extends beyond a rear axial end 46 of the rotor 34 and to a rear surface of the housing 26. The drive coupler 38 mates with the outer axial end of the shaft as described below. The rear end portion of the shaft 44 is borne by a bearing 48 that is coupled to the pump housing 26. The bearing 48 could be a ball, sleeve, roller bearing, or the like. An oil seal 50, such as a shaft, cup, or O-ring seal, is located axially between the bearing 48 and the rotor 34 to prevent leakage of the oil from the housing 26.

Figure 5:
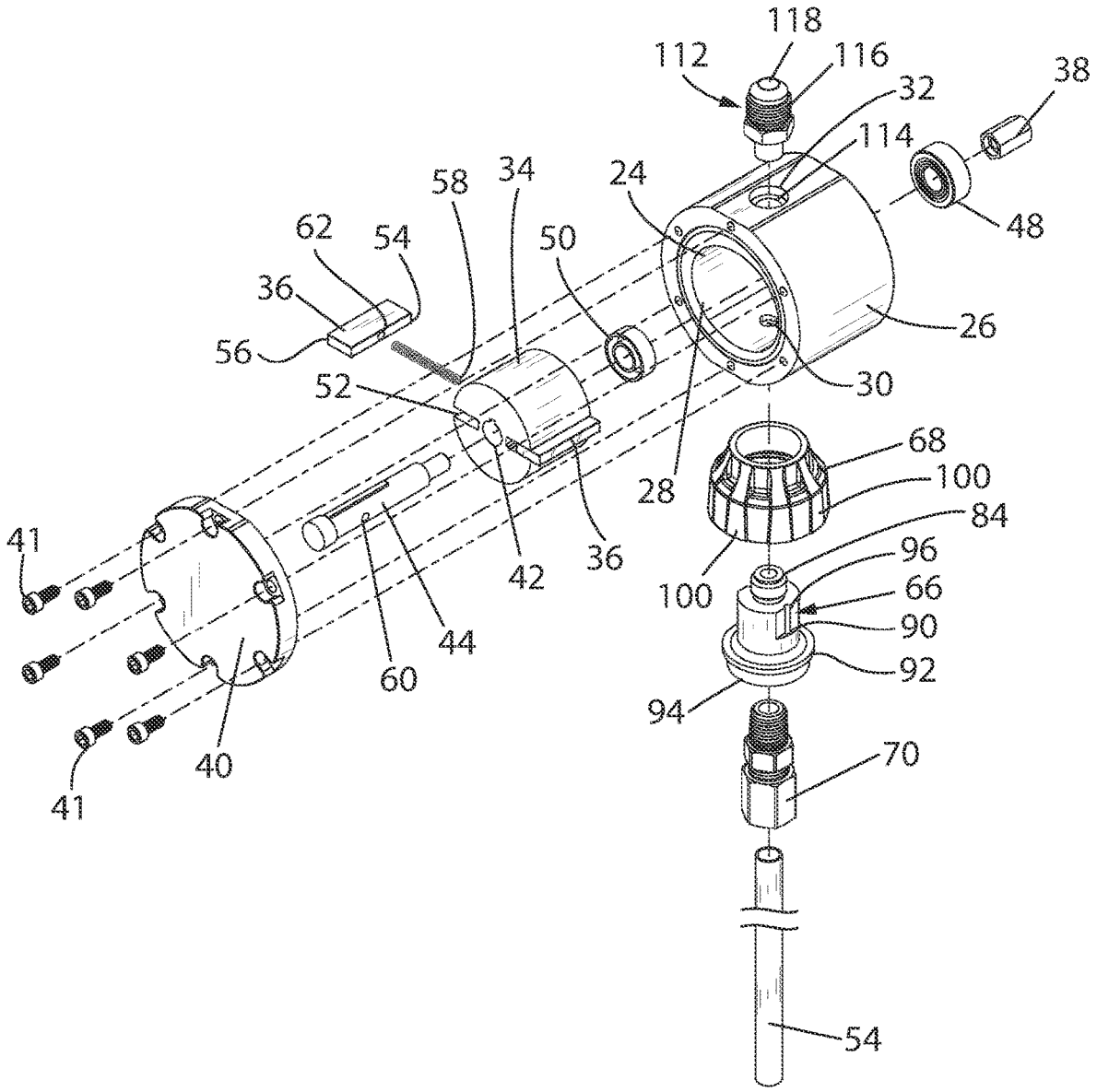
FIG. 5 is an exploded isometric view of the powered oil pump of FIG. 1.
Figure 6:
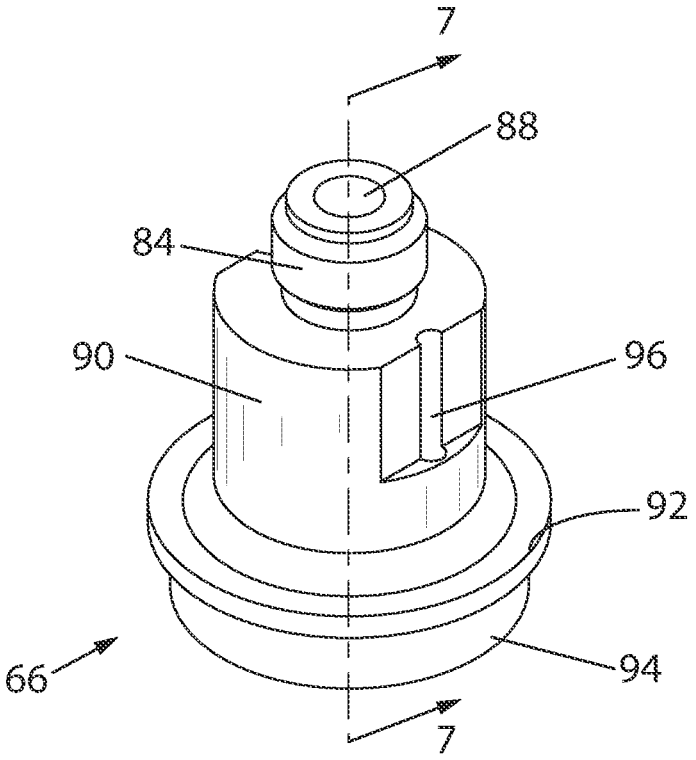
FIG. 6 is an isometric view of an interface fitting of the powered oil pump of FIG. 5.
Figure 7:
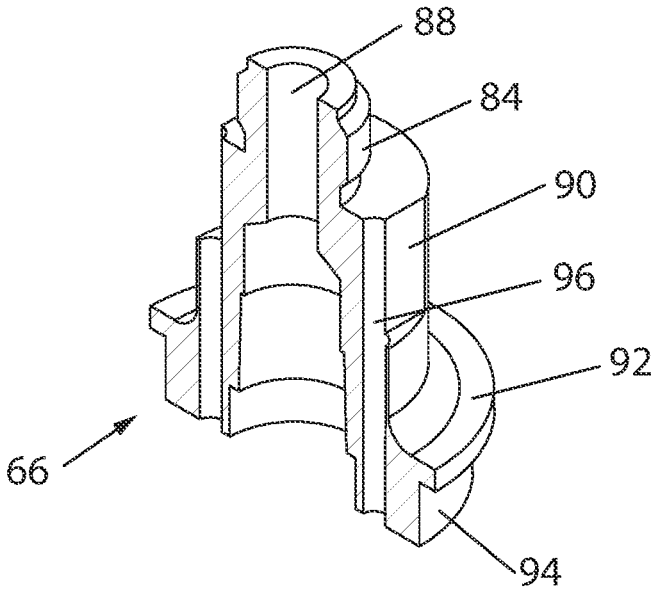
FIG. 7 is a sectional view of the interface fitting, taken generally along line 7-7 of FIG. 6.

Referring to FIGS. 3 and 5, at least one axially extending slot 52 is formed in the outer peripheral surface of the rotor 34. For instance, as shown, the rotor 34 includes two slots 52 formed in opposite sides of the rotor 34. As can be seen more clearly in FIG. 4, rotor vanes 36 are inserted into the two side slots 52. Each rotor vane 36 may be formed of a metal such as steel or aluminum or a plastic. Each rotor vane 36 has an inner end surface 54 received in the associated slot 52 and an outer end surface 56 that may be flat or may be curved at a specific radius. Vanes 36 with a curved radius at the end surface 56 provide a smooth interface between the housing sidewall 34 and the end surface 56, which reduces the risk of damage to the outer end surfaces 56.

Each of the vanes 36 may be spring biased toward the inner peripheral surface 28. In the illustrated configuration in which two vanes 36 are provided, a single spring 58 extends through a radial through-bore 60 in the shaft 44 so that its respective ends extend through openings formed in the bottom of the respective slots 52 and into counterbores 62 formed in the inner end surfaces 54 of the respective vanes 36 as best seen in FIG. 5. By ensuring constant pressure against the inner peripheral surface 28 of each of the vanes, the spring 58 ensures that a vacuum is created when the rotor 34 is rotated. Alternatively, where a spring-loaded vane 36 is not used, the rotor 34 may still be used, although ample centrifugal force within the pump mechanism 22 is needed to ensure the vanes 36 achieve the same, correct pumping action.

Referring to FIGS. 1-5, the powered compressor oil pump 20 includes an inlet assembly 64 located beneath the housing 26 and configured to supply oil to the housing lower inlet 30. The inlet assembly 64 includes an interface fitting 66, an interface nut 68, a compression fitting 70, and a dip tube 72.

Figure 8:
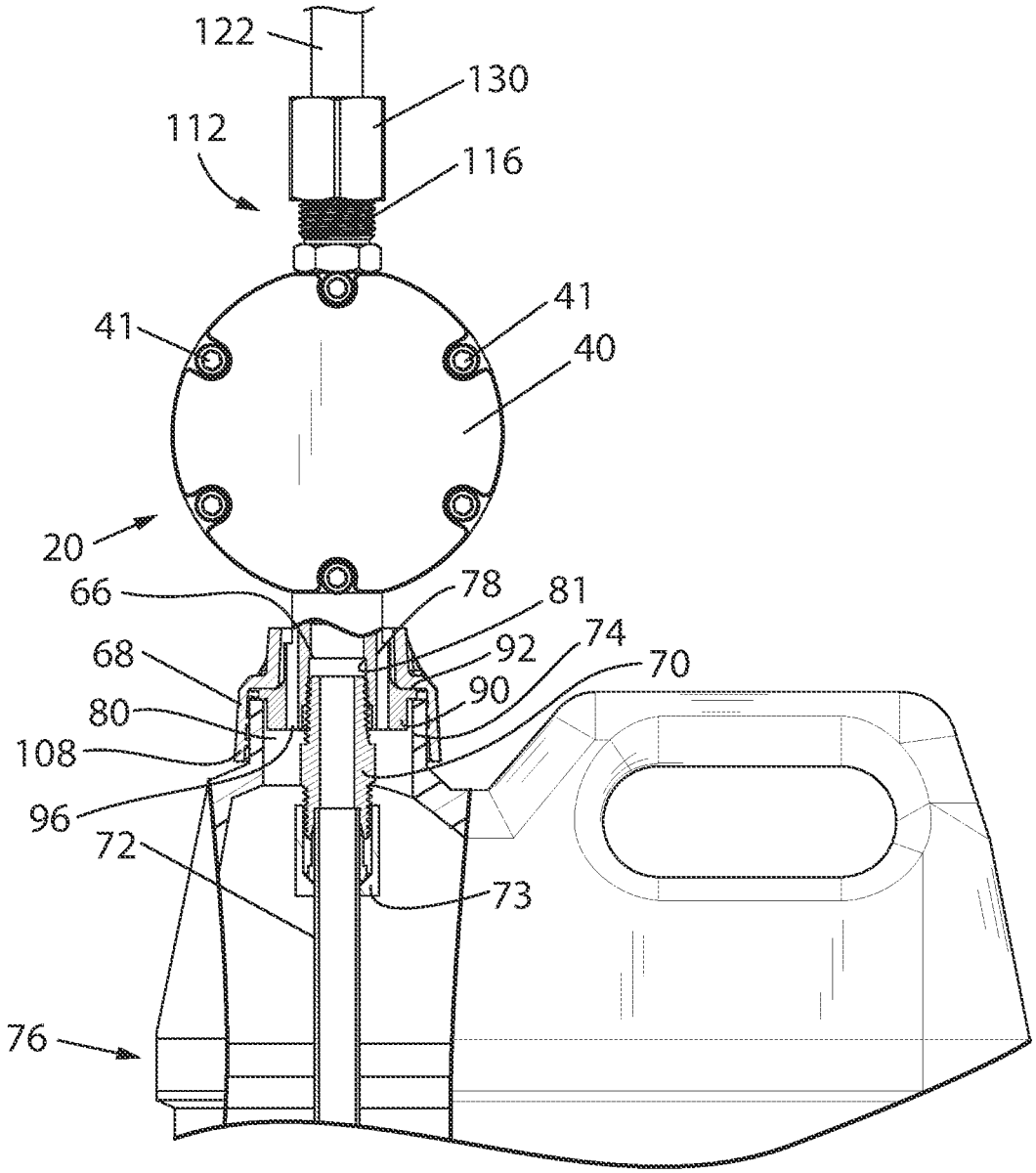
FIG. 8 is front elevation view of the powered oil pump of FIG. 1 in alignment with an oil container.

Looking to FIGS. 5-9, the interface fitting 66 is configured to cooperate with an externally threaded upper neck 74 of the container 76 (FIG. 8). The neck 74 terminates in an upper end 78 and has an inner oil delivery opening 80. The interface fitting 66 is generally cylindrical in shape with a bore 81 extending through the length of the fitting 66. The interface fitting 66 also has a top section 84 that fits within a port 86 located in the bottom of the pump housing 26. The port 86 is coupled to the lower inlet 30 of the housing chamber 24 by an internally threaded through bore 88. The top section 84 may be threaded so that the interface fitting 66 can be screwed into the port 86. Alternatively, as shown, the top section 84 can be dimensioned such that it is pressed into, and held within the port 86 and bore 88 using friction. Maintenance personal who are accustomed to attaching the inlet of a bicycle-type pump to a threaded bottle neck will readily adapt to this new pump, resulting in fast and easy set-ups for oil transfer. Threading the pump onto the jug also provides rigidity. Such rigidity is desirable as the torsion imposed on the pump 20 during operation tends to rotate the entire pump 20. When the pump is attached to the bottle, this force is completely controlled by holding the bottle itself.

Referring to FIGS. 5-9, beneath the top section 84, the interface fitting 66 has a body 90 with a bottom annular ridge 92 that extends down to an extended boss 94 of reduced diameter when compared to that of the ridge 92. The bottom annular ridge 92 has a diameter that is slightly larger than the diameter of the opening 80 in the neck 74 of the container 76 (FIGS. 8 and 9), such that the bottom annular ridge 92 rests on the upper end 78 of the neck 74 of the container 76, and seals the container 76 once installed. The extended boss 94 has a diameter that is slightly smaller than the inside diameter of the neck 74 of the container 76, such that the extended boss 94 can be inserted into the opening 80 and surrounded by the neck 74. As a result, when the powered compressor oil pump 20 is secured to the container 76, the interface fitting 66, and more specifically the extended boss 94, serves as a guide that aligns with the opening 80 to appropriately locate the powered compressor oil pump 20 on the neck 74 of the container 76. The interface fitting 66 may be equipped with at least one ventilation opening 96 to allow for air to pass into the container 76 when the pump 20 is in use. The ventilation opening 96 reduces pressure from within the container 76, which could lead to collapse of the container 76. Additionally, the ventilation opening 96 allows atmospheric pressure to assist with the pumping process.

The top section 84 of the interface fitting 66 is surrounded by the interface nut 68. As shown in FIGS. 4 and 5, the interface nut 68 is generally circular, with a plurality of axially-extending external ribs 100 spaced peripherally around the exterior of the nut 68. Alternatively, the interface nut 68 may also be hexagonal, square, or other shapes as desired. The interior 104 of the interface nut 68 has threads 106 that engage the threads 108 found on the neck 74 of the container 76. A circular opening 110 is formed in the bottom center of the interface nut 68, with a diameter that is slightly larger than the diameter of the body 90 of the interface fitting 66, but smaller than the diameter of the bottom ridge 92. As a result, the top section 84 and body 90 of the interface fitting 66 can be inserted into the circular opening 110 of the interface nut 68, and the interface nut 68 rests upon the bottom ridge 92 of interface fitting 66. The bottom ridge 92 fits securely within the interior 104 of the interface nut 68, such that the interface nut 68 and the interface fitting 66 remain attached to one another when the pump 20 is in use.

Figure 9:
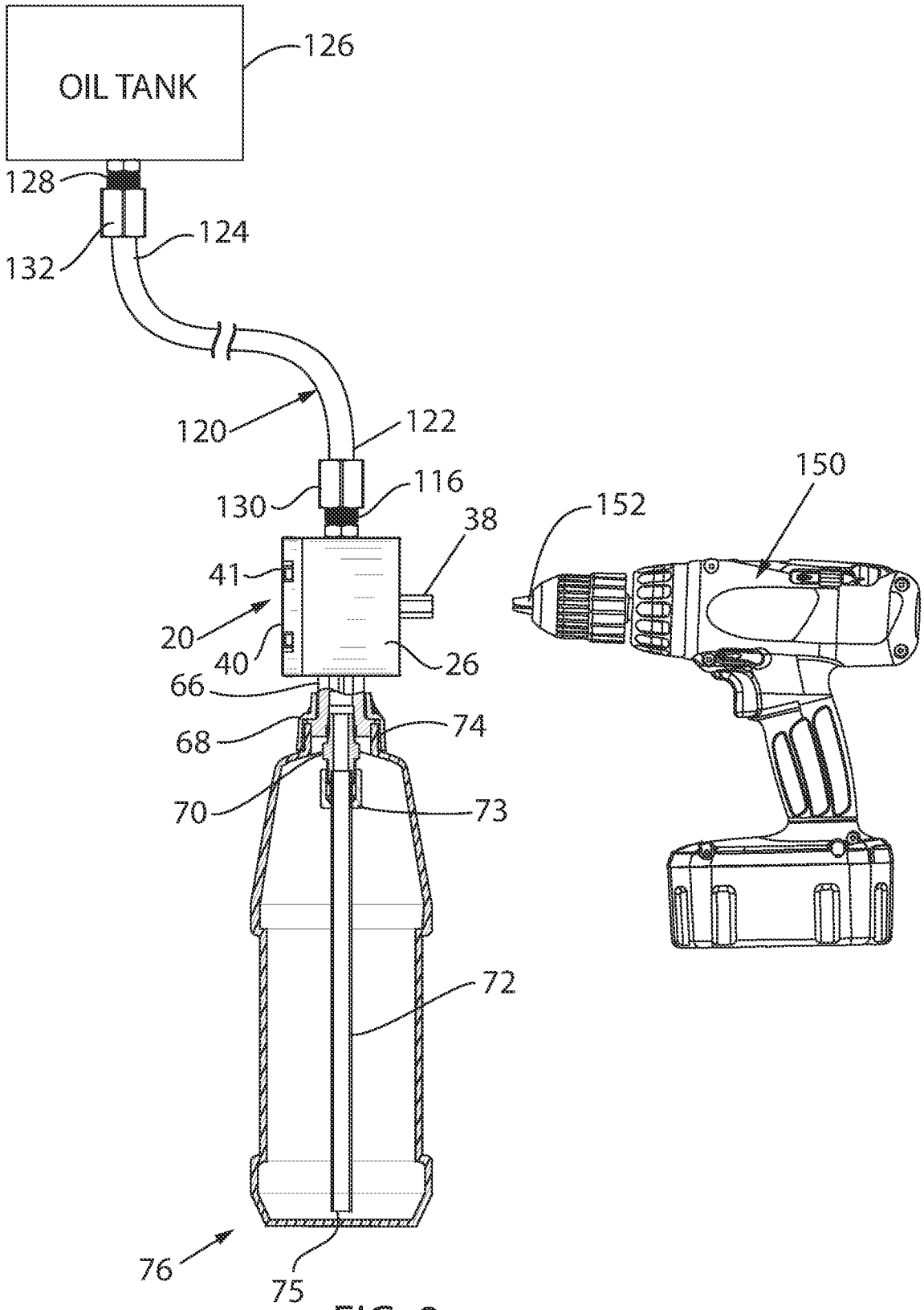
FIG. 9 is a side elevation view of the powered oil pump of FIG. 1 once it has been secured to the container and connected to a compressor or refrigeration system in need of oil.

The inlet section 64 also includes the compression fitting 70, which is coupled to dip tube 72. Preferably, the length of the dip tube 72 is set so that its bottom inlet 75 sits just above the bottom of the container 76 in use, as seen in FIG. 9. As best seen in FIGS. 4 and 5, the dip tube 72 is easily detachable from the compression fitting 70 by a compression nut 73, such that the tube 72 can easily be replaced with tubes of alternative lengths for different sized containers 76. Opposite the dip tube 72, the compression fitting 70 is secured within the bottom of the bore 82 of the interface fitting 66. For instance, the compression fitting 70 may have threads that engage threads formed in the interface fitting 66. The compression fitting 70 may also be secured to the interface fitting 66 using other mechanical fittings, including flares, compression, push-to-connect, or press fit mechanisms. Once the powered compressor oil pump 20 is installed, the dip tube 72 extends into the interior 84 of the container 76 and is used to pump the oil up into the housing 26.

When installing the powered compressor oil pump 20 to the container 76 as shown in FIG. 8, the extended boss 94 of the interface fitting 66 initially aligns with the opening 80 in the neck 74 of the container 76, the dip tube 72 is inserted into the opening 80, and the pump 20 is lowered to a position in which the ridge 92 rests on the upper end 78 of the neck 74 and the bottom of the dip tube 72 is located closely adjacent the bottom of the container 76. The interface nut 68 is then rotated to engage the threads 106 of the nut 68 with the threads 108 of the container 76. By first aligning the extended boss 94 of fitting 66 with the neck 74, the interface nut 68 can be quickly connected to the container 76 while minimizing the chance of cross-threading. Furthermore, the interface between the extended boss 94 and the neck 74, and the interface nut 68 and the neck 74 provides additional leverage to prevent the pump 20 from popping off the threads 108 during use. The ribs 100 can be helpful to rotate the interface nut 68 when oil gets onto the interface nut 68.

Referring again to FIGS. 3 and 444, the powered compressor oil pump 20 also includes an outlet assembly 112. As shown, the outlet assembly 112 is located above the housing, diametrically opposite the inlet section 64. Positioning the inlet and outlet assemblies 180 degrees from each other allows for the optimal combination of the inlet dip tube 72 being directly downwards into the oil bottle or jug 76 and the outlet being directly upwards towards the compressor service fitting. This provides a good ergonomic benefit. This relative orientation is enabled through the use of the specific rotary vane pump disclosed herein. A typical rotary vane design, on the other hand, places the inlet and outlet of the pump roughly 30-45 degrees away from each other on the same side of the pump.

Similar to the inlet assembly 64, the outlet assembly 112 also has a port 114 coupled to the upper outlet 32. The outlet assembly 112 port 114 is configured to receive a service fitting 116 with a hole 118 extending through it to allow for flow of oil. The service fitting 116 is an SAE standard 45-degree fitting, which allows the fitting 116 to connect to common systems, hoses, and tools that are used for heating, ventilation, and air conditioning service. By providing a service fitting 116 with a hole 118 with a larger inside diameter than is found in traditional service fittings, for instance an inside diameter of at least 0.22 inches, higher flow rates can be achieved.

Referring to FIGS. 8 and 9, the service fitting 116 may be mechanically coupled to the port 114 using threads, a press fit, or another mechanical mating technique. The service fitting 116 connects to a first end 122 of a tube 120. The second end 124 of the tube 120 is then connected to an inlet fitting 128 of an oil tank compressor 126, or other system in need of oil or other liquid. The tube 120 can be made of any suitable material, and as shown in FIG. 8 is a ⅜-inch flexible polyethylene tubing, which is chemically compatible with oil suitable for use with compressors. It also is sized for sufficient fluid flow on the order of 1 GPM, and is smooth to reduce friction when the system is in use. The tube 120 is coupled to the service fitting 116 by a first compression fitting 130 and to an oil tank fitting 126 by a second compression fitting 132.

Use of the powered compressor oil pump 20 after it is installed on the container 76 will now be described.

As the rotor 34 is rotated within the oblong internal chamber 24, the vanes 36 slide into and out of the slots 52 as they move around the chamber 24. As this motion occurs, a vacuum is created that draws oil up the dip tube 72. Oil is drawn into the internal chamber 24 through the inlet 30. Once in the internal chamber 24, the oil is moved upwardly using the vanes 36. As the oil reaches the top of the internal chamber 24, it is forced out of the outlet 32 in the chamber 24, out of the outlet assembly 112, and to the compressor through the tube 122.

As mentioned above, the pump 20 is powered by a powered drive of a hand-held tool rotatably coupled to the shaft 44 by the drive coupler 38. In the illustrated embodiment, drive coupler 38 is a hex drive having a first end threaded onto the outer end of the shaft 44 and a second end attachable to the chuck 152 forming the powered drive of a power drill 150. Since the pump 20 requires relatively little power to operate, a standard ⅜" inch hand drill will suffice. By powering the pump 20 with the drill 150 or another hand tool such as a power screwdriver, significantly improved flow rates can be achieved in comparison to primitive manual pump systems. For instance, a pump configured in accordance with the invention and powered by a standard hand drill may achieve flow rates of at least 1.0 GPM at a relatively high drive speeds (on the order of 1,000-1,200 rpms) or at least 0.5 GPM at a relatively low drive speed (on the order of 500-600 rpms). Depending on other conditions, including viscosity of oil, temperature of oil, and the like, even greater flow rates may be achieved. In any event, flow rates in excess of 0.25 GPM are easily achievable. Typical manual bicycle style hand pumps, in contrast, are hard-pressed to achieve flow rates in excess of 0.2 GPM.

Additionally, it should be noted that the rotor 34 is configured such that clockwise rotation of the shaft 44 creates a vacuum and begins the pumping process. In the event that the drill 126 is run in a counter-clockwise direction, the drill 126 will purposely unscrew the hex drive 38 from the shaft 44 to prevent the pump 20 from running in reverse, which could result in damage to the pump 20.

Furthermore, the configuration of the pump housing 26 allows the inlet assembly 64 and outlet assembly 112 to be vertically aligned with one another. This vertical alignment, coupled with positioning of the pump 20 beneath the compressor 128, reduces the risk that the container 76 will fall over on its side during pump operation.

A second embodiment of the present invention may comprise a powered pump 20 for delivering oil to a compressor that is fluidically connected to a generally rigid intake pipe 160 or "handle bar" extending downwardly from the pump housing 26.

The rigid intake pipe 160 has an elongated, possibly cylindrical, body 162 and upper and lower ends 164 and 166 that are of increased diameter when compared to that of the body 162. The lower end 166 may be dimensioned to simply rest on the top of the neck 74 of a container 76 or may be provided with an interface fitting (not shown) as in the first embodiment for screwing the intake pipe onto the neck 74 of the container 76.

The body 162 of sufficient length and diameter to be grasped by an operator's hand during pump operation. That length typically is on the order of 6" to 12". A bore 181 extends axially through the rigid intake pipe 160. The body 162 has an outer surface that may be one of textured or contoured to improve the operator's grip on the pump assembly. The rigid intake pipe 160 may be coupled to a dip tube 72 via a compression fitting 70 and compression nut 73. Preferably, the length of the dip tube 72 is set so that its bottom inlet sits just above the bottom of the container 76 in use. The compression fitting 70, in turn, is threaded into mating threads 168 in the bottom of the bore 181.

Figure 10:
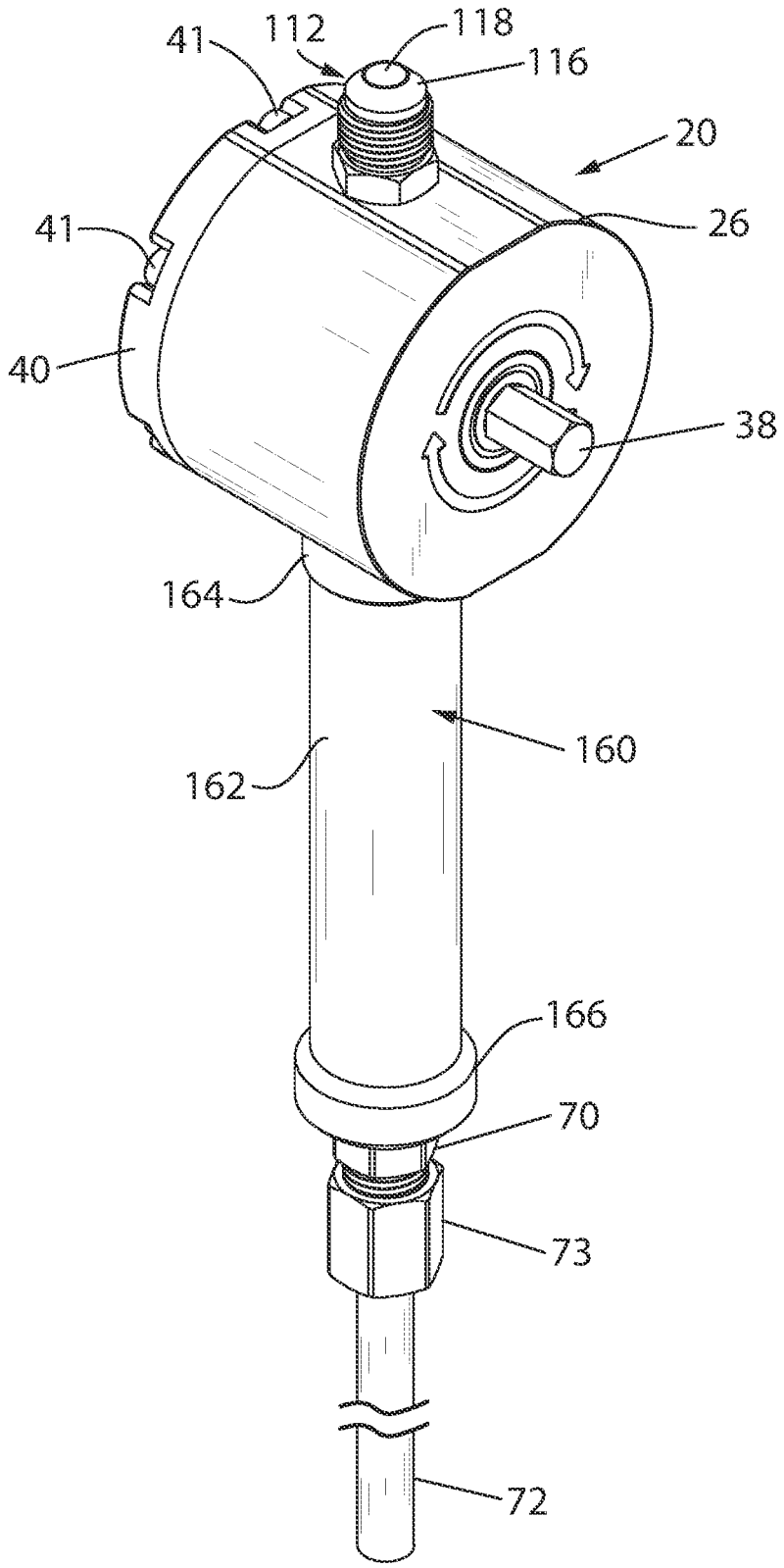
FIG. 10 is an isometric view of a powered oil pump constructed in accordance with a second embodiment of the invention incorporating a rigid intake pipe.
Figure 11:
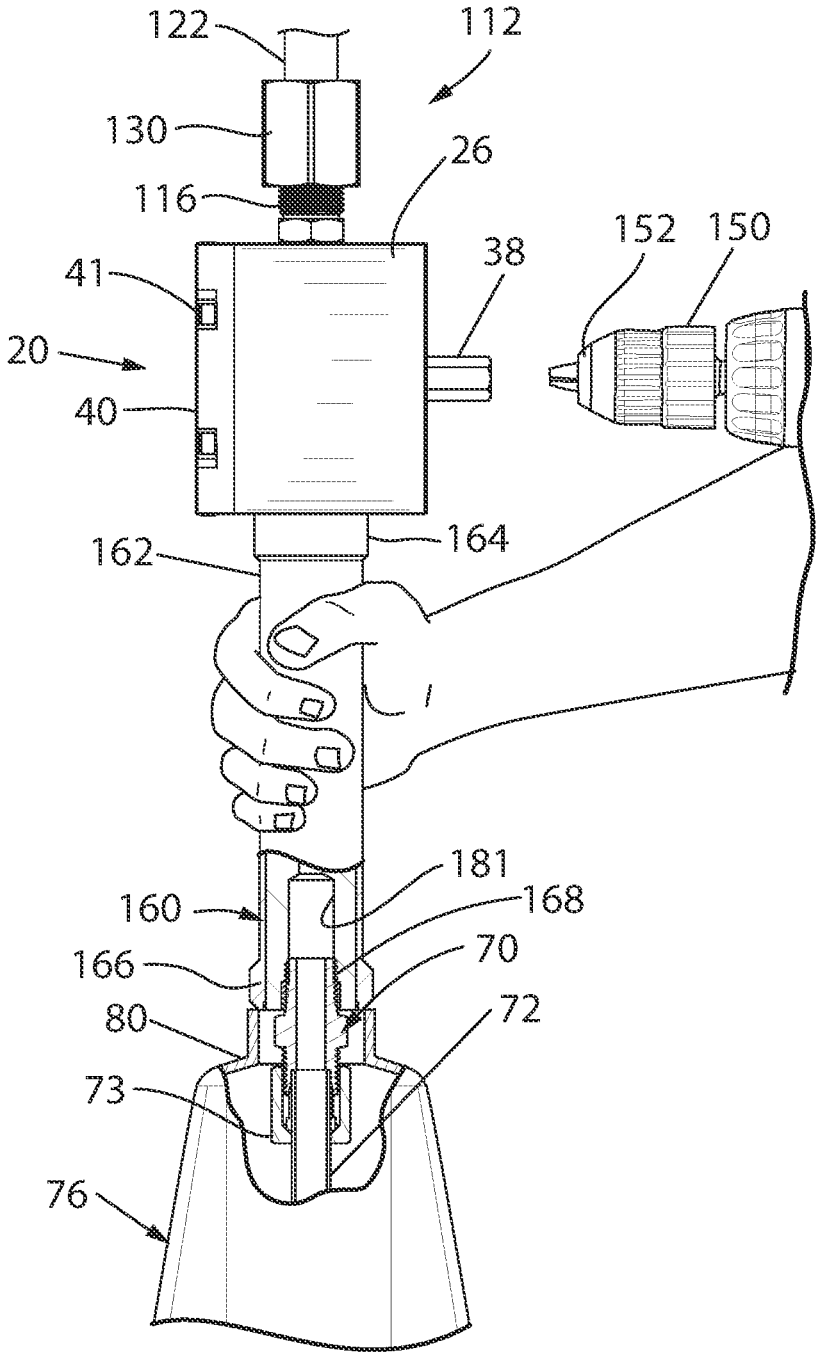
FIG. 11 is a partially cut-away side elevation view of the second embodiment of the powered oil pump of FIG. 10 in alignment with a power drill and with the rigid intake pipe grasped by an operator's hand.

Considering FIGS. 10 and 11, the upper end 164 of the rigid intake pipe 160 is has an interface that fits within the port in the bottom of the pump housing 26. The intake pipe interface may be threaded so that the interface can be screwed into the port 86. Alternatively, the intake pipe interface can be dimensioned such that it is pressed into, and held within the port 86 and bore 88 using friction.

When mating the second embodiment of powered compressor oil pump configured with the rigid intake pipe 160 to the container 76 as shown in FIG. 11, the dip tube 72 is inserted into the container opening 80 with the pump 20 held in position by the operator grasping the intake pipe body 162 with one hand, leaving the operator's other hand free to operate the power drill 150. Transfer of the oil from the container 76 to the receiving compressor then proceeds as previously described herein.

Although the figures are directed to a rotor pump, other pump designs could also be used with this system. For instance, the pump mechanism could take the form of a flexible impeller pump, which features a rotating impeller with an offset cam to generate suction and move fluid. Impeller pumps may be preferred where an inexpensive and simple design is preferred.

As should be clear from the foregoing, each of the components described above could be made of any suitable material, including steel, aluminum, another suitable metal, or plastic. Additionally, any of the components described above could be connected or attached by any suitable means. The specific methods of connection or attachment described above are examples of only some possible ways to connect or attach the various components to one another. Finally, to prevent oil from leaking out of the housing, oil seals may be located throughout the system.

Although the best modes contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the below claims.

We claim:

1. A pump for pumping oil from a container to a compressor of a refrigeration or cooling supply system, the pump comprising:

a pump housing having an internal pump mechanism situated within an eccentrically positioned, oblong fluid cavity defined by the pump housing, an inlet and an outlet positioned on opposite sides of the pump housing, and a drive shaft, the drive shaft being configured for connection to and to be rotatably driven by a powered drive of a power tool;

a dip tube being configured to extend into the container, the dip tube having an upper outlet in fluid communication with the inlet of the pump housing and a lower inlet configured to receive oil from the container; and a tube in fluid communication with the outlet of the pump housing and being configured to supply oil to the compressor of the refrigeration or cooling supply system.

2. The pump recited in claim 1, wherein the internal pump mechanism comprises a rotor pump.

3. The pump as recited in claim 2, wherein the rotor pump has a rotor with at least one rotor vane that extends outwardly from the rotor towards an inner peripheral wall of a chamber housing the rotor.

4. The pump as recited in claim 3, wherein the at least one rotor vane is removably connected to the rotor in a manner facilitating removal and replacement of the vane from the rotor, and wherein the at least one rotor vane is spring-biased toward the inner peripheral wall of the chamber housing the rotor.

5. The pump as recited in claim 4, wherein the drive coupler is threaded to the drive shaft so as to drive the drive shaft to rotate when the drive coupler is rotated in a first direction and to unscrew the drive coupler from the drive shaft when the drive coupler is rotated in a second direction opposite the first direction, thereby preventing driving of the pump in a reverse direction.

6. The pump as recited in claim 1, further comprising a drive coupler that is configured to releasably attach the drive shaft to the powered output of the power tool.

7. The pump as recited in claim 1, further comprising a generally rigid intake pipe extending downwardly from the pump housing and being sufficiently long to be grasped by an operator's hand during pump operation, the intake pipe having a lower inlet in fluid communication with the upper inlet of the dip tube.

8. The pump as recited in claim 7, wherein at least a portion of an outer peripheral surface of the intake tube is textured or contoured to facilitate grasping of the intake tube by the operator's hand.

9. The pump as recited in claim 1, further comprising an inlet assembly removably mountable to the container and having a container interface fitting including an internally threaded interface nut screwable onto an externally threaded neck of the container, wherein the upper outlet of the dip tube opens into the interface fitting.

10. The pump as recited in claim 9, further comprising a compression fitting located within the interface fitting and connecting the dip tube to the interface fitting.

11. The pump as recited in claim 9, wherein the interface fitting includes at least one through-hole that runs from the interior of the container to the exterior of the pump for permitting air to flow into the container as oil is pumped from the container.

12. A rotary vane pump for pumping oil from a container to a compressor of a refrigeration or cooling supply system, the pump comprising:

a pump housing and an eccentrically positioned, oblong fluid cavity defined by the pump housing, a lower inlet and an upper outlet positioned on opposite sides of the pump housing;

a pump mechanism located in the fluid cavity, the pump mechanism having a horizontally extending shaft, a rotor mounted on the shaft, at least one vane extending radially outwardly from the rotor toward an outer periphery of the fluid cavity, and a drive shaft extending horizontally from the pump housing, the drive shaft being configured for connection to and to be rotatably driven by a powered drive of a power tool;

a drive coupler that is configured to releasably attach the drive shaft to the powered output of the power tool;

a dip tube being configured to extend into the container, the dip tube having an upper end retained within the interface fitting and having upper outlet, and a lower inlet configured to receive oil from the container; and a tube connected to the outlet of the pump housing and being configured to supply oil to the compressor of the refrigeration or cooling supply system.

13. The pump as recited in claim 12, wherein the drive coupler is threaded to the drive shaft so as to drive the drive shaft to rotate when the drive coupler is rotated in a first direction and to unscrew the drive coupler from the drive shaft when the drive coupler is rotated in a second direction opposite the first direction, thereby preventing driving of the pump in a reverse direction.

14. The pump as recited in claim 12, wherein the at least one rotor vane is connected to the rotor in a manner facilitating removal and replacement of the rotor vane from the rotor, and wherein the at least one rotor vane is spring-biased toward an inner peripheral wall of a chamber housing the rotor.

15. The pump as recited in claim 12, further comprising an inlet assembly removably mountable to the container and having a lower inlet and an upper outlet in fluid communication with the inlet of the pump housing, the inlet assembly having a container interface fitting including an internally threaded interface nut screwable onto an externally threaded neck of the container.

16. The pump as recited in claim 12, further comprising a generally rigid intake pipe extending downwardly from the pump housing and being sufficiently long to be grasped by an operator's hand during pump operation, the intake pipe having a lower inlet in fluid communication with the upper inlet of the dip tube.

* * * * *